United States Patent [19]

Ishii et al.

[11] 4,432,290

[45] Feb. 21, 1984

[54] METHOD OF PYROLYZING ORGANIC MATERIAL USING A TWO-BED PYROLYSIS SYSTEM

[75] Inventors: Yoshiaki Ishii; Naoyoshi Ando; Tsutomu Kume; Shosaku Fujinami, all of Tokyo, Japan

[73] Assignee: The Agency of Industrial Science and Technology, Japan

[21] Appl. No.: 337,708

[22] Filed: Jan. 7, 1982

Related U.S. Application Data

[63] Continuation-in-part of Ser. No. 199,543, Oct. 22, 1980, Pat. No. 4,344,373.

[30] Foreign Application Priority Data

| | | | |
|---|---|---|---|
| Oct. 30, 1979 | [JP] | Japan | 54-139271 |
| Oct. 30, 1979 | [JP] | Japan | 54-139272 |
| Jan. 13, 1981 | [JP] | Japan | 56-2632 |

[51] Int. Cl.[3] ..... F23G 00/00

[52] U.S. Cl. ..... 110/346; 48/197 A; 110/224; 110/229; 110/238; 110/245; 122/4 D; 431/7

[58] Field of Search ..... 110/346, 347, 238, 245, 110/224, 229; 122/4 D; 431/7, 170; 48/197 A, 209

[56] References Cited

U.S. PATENT DOCUMENTS

| | | | |
|---|---|---|---|
| 3,761,568 | 9/1973 | Brink et al. | 48/209 |
| 4,159,682 | 7/1979 | Fitch et al. | 110/245 |
| 4,223,529 | 9/1980 | Willyoung | 122/4 D |
| 4,330,411 | 5/1982 | Florin et al. | 110/346 |
| 4,344,373 | 8/1982 | Ishii et al. | 110/347 |

FOREIGN PATENT DOCUMENTS

| | | | |
|---|---|---|---|
| 55-112922 | 1/1980 | Japan | 110/245 |

*Primary Examiner*—Edward G. Favors
*Assistant Examiner*—Steven E. Warner
*Attorney, Agent, or Firm*—Steinberg & Raskin

[57] ABSTRACT

An improvement in a method of pyrolysis wherein an organic material, such as city waste, is pyrolyzed using a two-bed type pyrolysis system including a fluidized bed type pyrolysis reactor and a combustion reactor and wherein energy is recovered from burning the pyrolysis gases produced is disclosed. The improvement comprises recovering the heat of a combustion exhaust gas which is generated when the energy of the pyrolysis gas is recovered, heating a fluid medium with the recovered heat, and heating the organic material to be pyrolyzed with the heated fluid heat medium to dry the organic material before it is pyrolyzed.

13 Claims, 4 Drawing Figures

METHOD OF PYROLYZING ORGANIC MATERIAL USING A TWO-BED PYROLYSIS SYSTEM

CROSS REFERENCE TO RELATED APPLICATION

This is a continuation in part of our copending application Ser. No. 199,543, filed Oct. 22, 1980, now U.S. Pat. No. 4,344,373 issued Aug. 17, 1982.

BACKGROUND OF THE INVENTION

This invention relates in general to methods of pyrolysis and, more particularly, to a pyrolysis method in which an organic material, such as biomass or city waste, is pyrolyzed in a two-bed type pyrolysis system which includes a fluidized bed type pyrolysis reactor and a combustion reactor to obtain a high-energy fuel gas as the pyrolysis gas.

Methods have been proposed for the gasification of municipal waste and biomass to produce high energy fuel gas. However, biomass and municipal waste generally have a high water content and when such material is fed to a pyrolysis apparatus a large amount of heat is required for pyrolysis thereof since much heat is consumed in the vaporization of the water.

For example, in a partial oxidation type pyrolysis method in which an organic material is pyrolyzed utilizing heat generated through the burning of part of the material, it is necessary to supply large amounts of air to the material, to oxidize and burn the same. Accordingly, the recovered fuel gas contains $N_2$ from the air and $CO_2$ remaining in the reaction zone after the material has been combusted, thereby resulting in the fuel gas having a relatively low calorific value.

In a two-bed type pyrolysis operation, a heat medium is heated with the heat generated by the combustion of char and tar which are by-products of the pyrolysis of a material. The heat medium is circulated between a fluidized bed type pyrolysis reactor and a combustion to thereby obtain the heat required for pyrolyzing the material. In such two-bed type pyrolysis operations, it is necessary that a large amount of recovered fuel gas in addition to char and oil be burned in order to supply sufficient heat to the material. Therefore, this pyrolyzing method also has a relatively low gas recovery rate.

The fuel gas recovered in pyrolyzing methods is utilized as a power source. Thus, the fuel gas is burned such, for example, as by a gasoline or a gas turbine or the like. However, the combustion exhaust gas is merely discharged to the ambient atmosphere or, since it has a high temperature, can be used to heat water.

SUMMARY OF THE INVENTION

Accordingly, it is an object of the present invention to provide a pyrolysis method which is free from the drawbacks of the conventional pyrolysis methods discussed above. Another object of the present invention is to provide a pyrolysis method which improves the quality and recovery rate of the fuel gas in a pyrolysis system by reducing the water content of an organic material before it is pyrolyzed.

Still another object of the present invention is to provide a new and improved pyrolysis method whereby a wider range of materials can be pyrolyzed than in the use of conventional techniques.

Briefly, in accordance with the present invention these and other objects are attained by providing an improvement in a pyrolysis method wherein an organic material, such as municipal waste, is pyrolyzed using a two-bed pyrolysis system including a fluidized bed type pyrolysis reactor and a combustion reactor and wherein energy is recovered from burning the pyrolysis gases produced. The improvement comprises (a) recovering the heat of a combustion exhaust gas which is generated in the energy recovery, (b) heating a fluid heat medium with the recovered heat, and (c) heating the organic material to be pyrolyzed with the heated fluid heat medium, thereby drying the organic material before it is pyrolyzed.

According to another feature of the present invention, heat is recovered from the combustion exhaust gas discharged from the combustion reactor and used as necessary to heat the fluid heat medium.

In the pyrolysis method of the present invention, the organic material is heated either directly or indirectly by the fluid heat medium.

The heat recovery is carried out utilizing a boiler or a heat exchanger. The fluid heat medium may be constituted by steam, air, oil or the like.

In one preferred embodiment of the present invention, the organic material to be pyrolyzed is divided into a component having a high water content and a component having a low water content, and only the high water content component is pre-heated by the fluid heat medium.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
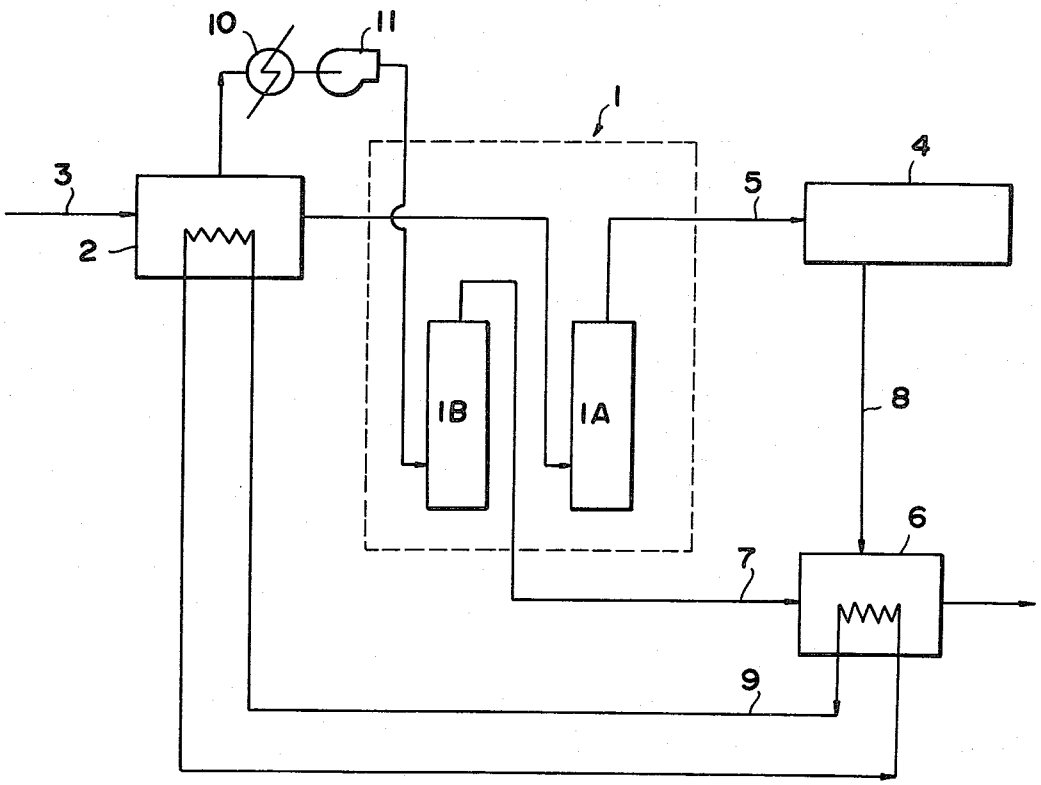
FIGS. 1–4 are flow charts, each illustrating a respective embodiment of a pyrolysis method according to the present invention.

Referring now to the drawings wherein like reference characters designate identical or corresponding parts throughout the several views, and more particularly to FIG. 1, a two-bed type pyrolysis apparatus is generally designated 1. Such two-bed type pyrolysis apparatus are known in the art and, for example, reference is made to U.S. Pat. No. 3,853,498 issued Dec. 10, 1974 and U.S. Pat. No. 4,344,373 issued Aug. 17, 1982, of which the instant application is a continuation in part, said patents disclosing such pyrolysis apparatus. Referring to FIG. 1, apparatus 1 includes a fluidized bed type pyrolysis reactor 1A and a combustion reactor such, for example, as a fluidized bed type combustion reactor 1B. In such apparatus, heat medium particles such, for example, as sand are calculated between the reactors 1A and 1B to burn the by-products, such as char and oil, in the combustion reactor 1B, and supply the combustion heat to the organic material to be pyrolyzed.

A conventional drying machine 2 is provided for heating the organic material to be pyrolyzed, for example the municipal waste 3, in order to dry the same prior to pyrolyzation. An energy recovery device 4, such as a conventional gasoline engine or gas turbine, is provided which is adapted to burn a fuel gas 5 produced as the pyrolysis gas and recover the energy from it in the form of electric power. An exhaust heat recovery device 6, such as a conventional waste gas boiler, is provided. The exhaust heat recovery device 6 is adapted to be heated by the combustion exhaust gas 7 discharged from the combustion reactor of the two-bed type pyrolysis apparatus 1 (the fluidized bed type combustion reactor 1B in the illustrated embodiment), and by a combustion exhaust gas 8 from the energy recovery device 4. A fluid heat medium 9 is associated with the exhaust heat recovery device 6, the fluid heat medium 9 being turned into steam in the heat recovery device 6 under the heating of combustion exhaust gases 7 and 8. Reference numeral 10 designates a cooler of any conventional design and reference numeral 11 designates a blower.

In operation, the waste 3 delivered to be pyrolyzed is first crushed to a predetermined particle size by conventional techniques in order to improve the drying efficiency, pyrolysis reaction rate and handling efficiency thereof. The crushed waste is then charged into the drying machine 2 and is heated with steam 9 (the fluid heat medium supplied from the exhaust heat recovery device 6) indirectly via a heating wall such, for example, as the wall of a heating pipe or a boiler drum, whereupon the waste material is dried. The vaporized water carried by the gas is drawn into blower 11, the vaporized water being removed as necessary in the cooler 10, and the gas is then supplied to the fluidized bed type combustion reactor 1B in the two-bed type pyrolysis apparatus 1.

The waste 3 is then pyrolyzed in the fluidized bed type pyrolysis reactor 1A to produce a gas, char and oil. The char and oil is burned in the fluidized bed type combustion reactor 1B to generate the heat necessary for the pyrolysis of the waste.

The recovered fuel gas 5 is introduced into the energy recovery device 4 to produce electric power, which may be supplied to the pyrolysis apparatus 1 as well as other machines, surplus electric power being supplied to external equipment.

The combustion exhaust gas 7 generated from the combustion of the char and oil in the fluidized bed type combustion reactor 1B in the pyrolysis apparatus 1 and the combustion exhaust gas 8 from the energy recovery device 4, are introduced into the exhaust heat recovery device 6 to generate the steam 9. The steam 9 thus generated, or a portion thereof, is directed as the fluid heat medium to the drying machine 2 wherein it is used for the preliminary drying of the waste 3 described above.

The vaporized water, which generally carries a foul smelling component, is drawn from the drying machine 2 into the blower 11 and is used as a part of the waste-burning air in the fluidized bed type combustion reactor 1B where it is decomposed and thereby loses its foul odor.

The extent of the decrease in the water content of the organic material to be pyrolyzed after the preliminary drying operation in the drying machine 2 depends upon the amount of heat in the steam 9, i.e., the amount of heat in the combustion exhaust gases 7 and 8. The precise calorific value of the steam 9 can be determined by calculations of heating values. More particularly, an approximation is first made of the water content of the waste 3 after drying. The heat balance in the pyrolysis apparatus 1 is calculated in order to determine the calorific value of the combustion exhaust gas 7 and the recovery rate of the fuel gas 5. The calorific value of the combustion exhaust gas 8, which is produced after fuel gas 5 has been burned in the energy recovery device 4, is then determined. The amount of heat transferred to the steam 9, which serves as a fluid heat medium, is thereafter calculated on the basis of both the calorific value of the combustion exhaust gas 8 and of the calorific value of the combustion exhaust gas 7 generated in the fluidized bed type combustion reactor 1B in the two-bed type pyrolysis apparatus 1. The amount of heat in the steam 9 serving as the fluid heat medium is checked as to whether it is high enough to sufficiently dry the waste 3. When the calorific value of the steam 9 is not sufficiently high, the water content of the waste 3 after drying is reapproximated and the above calculations repeated.

The pyrolysis operation is carried out on the basis of the water content of the waste, which is determined after trial calculations have been made in a repeated fashion as described above.

In order to transmit heat from the steam 9 to the waste 3 in an effective manner, it is preferable that the drying machine 2 be constructed in a rotatable fashion in the same manner as conventional dryers of this type, or that the drying machine 2 be provided with a paddle to agitate the waste 3 in order to promote effective and uniform drying thereof.

Figure 2:
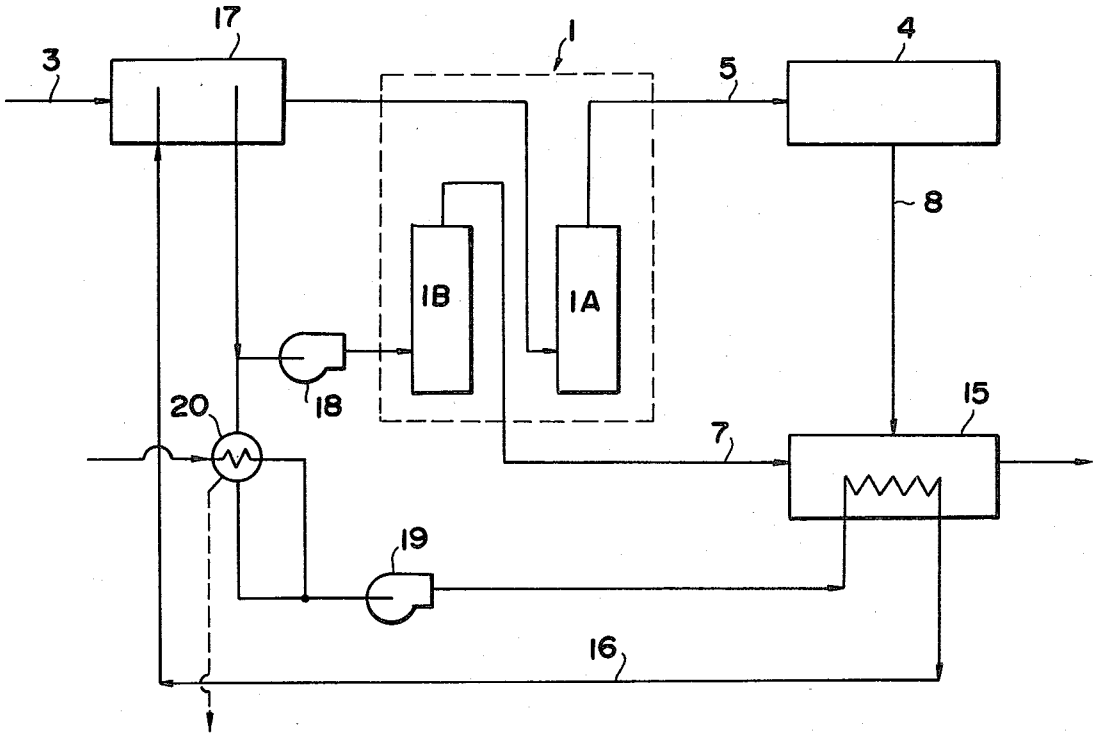

Referring now to the embodiment of the method illustrated in FIG. 2, the same or corresponding elements as in the first embodiment are designated by the same reference numerals. In this second embodiment, a heat exchanger is employed as the exhaust heat recovery device 15 and air 16 is employed as the fluid heat medium. The heated air 16 comes into direct contact with the waste 3 in the drying machine 17 so that the waste 3 is directly heated and dried. In order to improve the heat transfer rate, it is preferable that a drying machine 17 be constructed in a rotatable fashion or provided with a paddle to agitate the waste 3 as mentioned above.

The air, whose temperature has decreased in the drying machine 17, is discharged therefrom with water vapor and a foul smelling component. A portion of the air is supplied as waste-burning air by a blower 18 to the fluidized bed type combustion reactor 1B in the two-bed type pyrolysis apparatus 1 which has the same construction as the apparatus 1 utilized in the first embodiment, and the foul smelling components are decomposed therein. Fresh air is added to the remaining part of the air discharged from the drying machine 17 and the resulting air is pressurized by a blower 19 to be returned to the exhaust heat recovery device 15. When fresh air is added to the portion of the air as discussed above which is discharged from the drying machine 17, the air from the drying machine is subjected to heat exchange in a cooler 20 in order to condense the vaporized water. The resulting water is removed and the fresh air then pre-heated. This will minimize any heat loss and remove the water in the drying air thereby increasing the drying efficiency.

Moreover, in the second embodiment of the invention illustrated in FIG. 2, oil may be used in lieu of air 16, the oil being heated in the heat exchanger which constitutes the exhaust heat recovery device 15 so that the resulting hot oil is used as the fluid heat medium. In this case, the indirect-heating type drying machine 2 employed in the first embodiment may be used in lieu of the drying machine 17 to heat the waste 3 indirectly.

Figure 3:
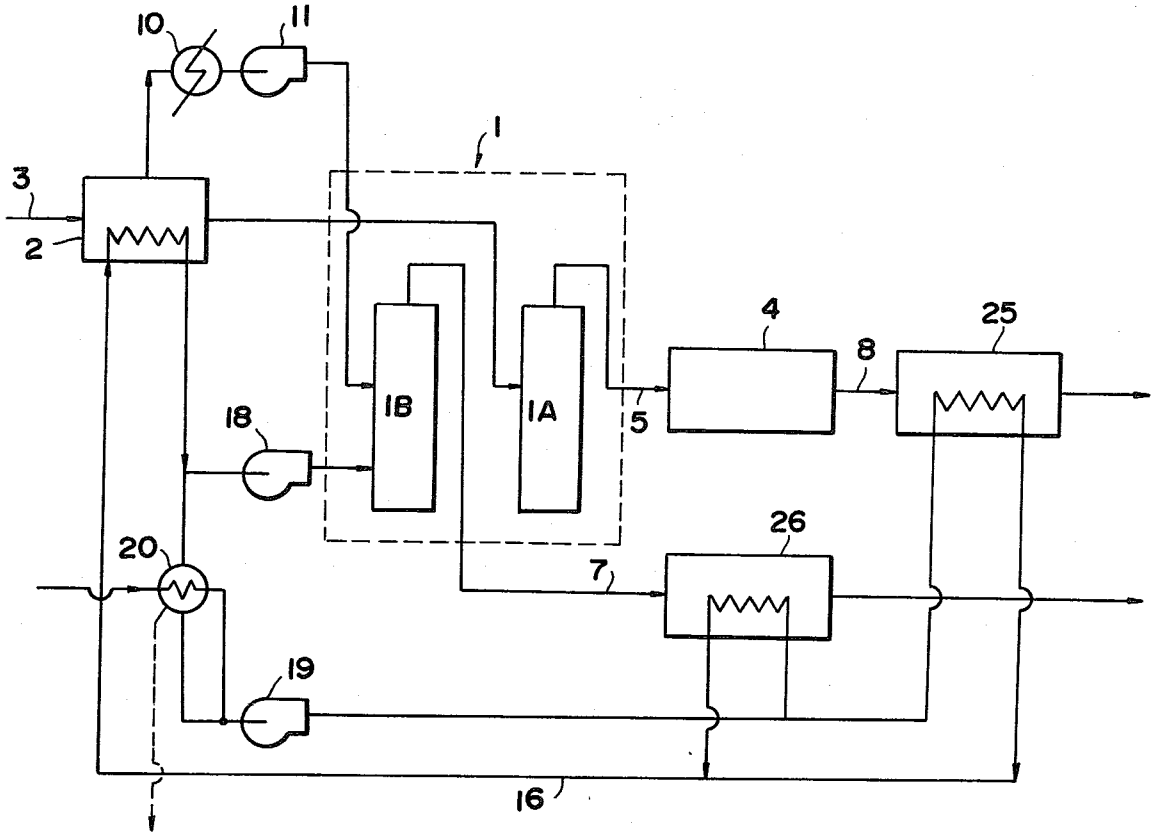

Turning now to FIG. 3, a third embodiment of the present invention is illustrated which is provided with exhaust heat recovery devices 25 and 26 constituted by separate heat exchangers for the combustion exhaust gases 7 and 8 respectively. Elements of this embodiment which are identical with corresponding elements of the embodiment illustrated in FIGS. 1 and 2 are designated by the same reference numerals and have the same function as described above.

Figure 4:
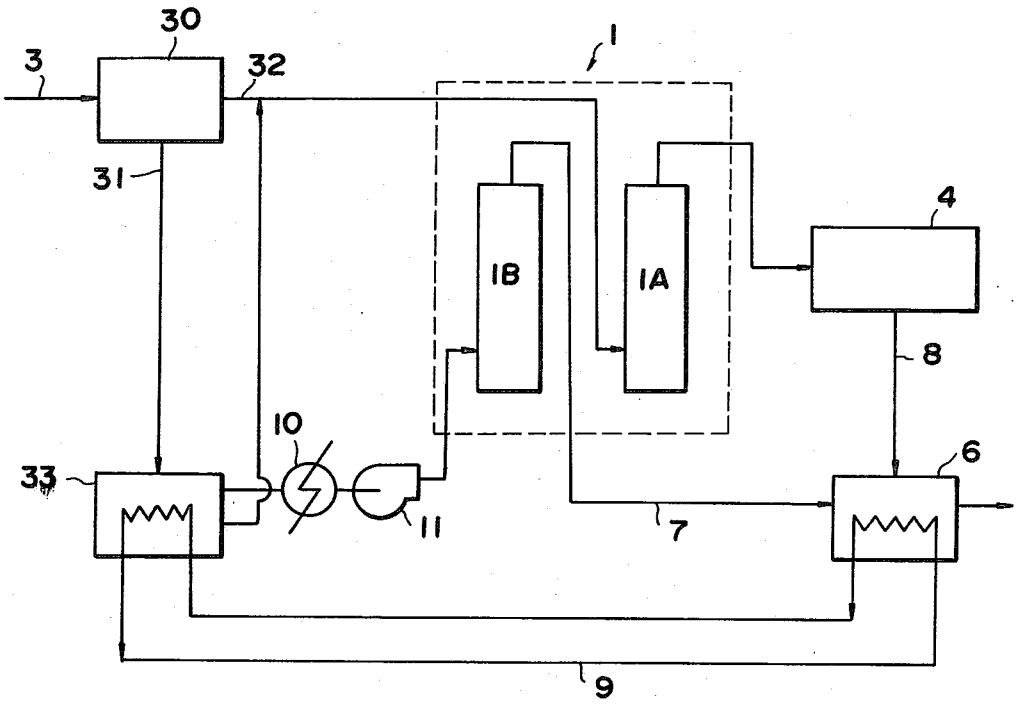

FIG. 4 is a flow chart of a fourth embodiment of the present invention wherein the waste 3 is initially subjected to a separation step by means of a conventional separator 30 which crushes and sieves the waste 3.

In this connection, municipal waste generally consists of garbage, waste paper, and plastic scrap. The garbage will have the highest water content and is generally crumbly. Accordingly, the municipal waste is crushed, the greater part of the garbage is broken into smaller sized particles. Therefore, the crushed municipal waste can be separated by a sieve into garbage 31, the greater part of which consists of refuse from kitchens and has a high water content, and waste paper and plastic scrap 32, which have a low water content. When the garbage 31 which has been separated from the municipal waste is alone introduced, for example, into an indirect heating type drying machine 33, it can be dried with less calorific power than the municipal waste in an unseparated state. Therefore, when the results of the calculations of calorific values discussed above indicate that calorific values which are sufficiently high to dry the municipal waste to reduce the water content thereof to a predetermined level cannot possibly by obtained, it is preferable to preliminarily separate the municipal waste as indicated in the fourth embodiment of the invention. When calculations of calorific values indicate that the municipal waste can be dried sufficiently with the heat of one of the combustion exhaust gases 7 or 8, either of them may be utilized, and, especially the combustion exhaust gas 8 from the energy recovery device 4 can be advantageously utilized. The elements of the system illustrated in FIG. 4 which are identical to elements found in the embodiments illustrated in FIGS. 1–3 are designated by the same reference numerals and function in the same manner.

The present invention thus provides a pyrolysis method which permits a reduction in the water content prior to the organic material being pyrolyzed by effectively utilizing the heat of a combustion exhaust gas and thereby improving the recovery percentage in quality of gas, the recovery percentage of energy, and an expansion of the range of materials which can be pyrolyzed. The pyrolysis method of the present invention therefor has extremely great practical energy-recovering effects.

Obviously numerous modifications and variations of the present invention are possible in the light of the above teachings. It is therefor to be understood that within the scope of the claims appended hereto, the invention may be practiced otherwise than as specifically disclosed herein.

What is claimed is:

1. In a method of pyrolysis of organic material, such as municipal waste, utilizing a two-bed pyrolysis system including a fluidized bed type pyrolysis reactor and combustion reactor and wherein the pyrolysis gas produced in the method is burned and its energy recovered, the improvement comprising the steps of:

recovering the heat of a first combustion exhaust gas produced when the energy is recovered;

heating a fluid heat medium with the heat thus recovered;

and heating organic material prior to the pyrolysis thereof with the heated fluid heat medium, whereby the organic material can be dried before it is pyrolyzed.

2. In a method of pyrolysis of municipal waste including garbage, waste paper and plastic scrap, utilizing a two-bed pyrolysis system including a fluidized bed type pyrolyis reactor and combustion reactor and wherein the pyrolysis gas produced in the method is burned and its energy recovered, the improvement comprising the step of:

recovering the heat of a first combustion exhaust gas produced when the energy is recovered;

heating a fluid heat medium with the heat thus recovered;

crushing and sieving said municipal waste to be pyrolyzed to separate the same into a component comprising garbage having a high water content and a component comprising said waste paper and plastic scrap which has a low water content; and heating only said high water content component of said municipal waste prior to the pyrolysis thereof with the heated fluid heat medium, whereby said high water content component of said municipal waste is dried before it is pyrolyzed.

3. In a method of pyrolysis of organic material, such as municipal waste, utilizing a two-bed pyrolysis system including a fluidized bed type pyrolysis reactor and combustion reactor and wherein the pyrolysis gas produced in the method is burned and its energy recovered, the improvement comprising the steps of:

recovering the heat of a first combustion exhaust gas produced when the energy is recovered;

heating a fluid heat medium with the heat thus recovered;

separating the organic material to be pyrolyzed into a component having a high water content and a component having a low water content; and heating the high water content component of said organic material prior to the pyrolysis thereof with the heated fluid heat medium, whereby the organic material can be dried before it is pyrolyzed.

4. The method of claim 3 including the further step of heating said fluid heat medium with heat recovered from a second combustion exhaust gas which is discharged from the combustion reactor.

5. The method of claim 3 wherein said organic material heating step is constituted by directly heating the organic material with said fluid heat medium.

6. The method of claim 5 wherein said heat recovery step is carried out utilizing a heat exchanger, and wherein said fluid heat medium is constituted by air.

7. The method of claim 3 wherein said organic material heating step is constituted by indirectly heating the organic material with said fluid heat medium.

8. The method of claim 7 wherein said heat recovery step is carried out utilizing a heat exchanger, and wherein said fluid heat medium is constituted by oil.

9. The method of claim 3 wherein said heat recovery step is carried out utilizing a boiler, and wherein said fluid heat medium is constituted by steam.

10. The method of claim 9 further including the step of directing at least a component of the vaporized water produced during the step of heating the organic material into the combustion reactor wherein it is used as a part of the waste-burning air.

11. The method of claim 6 further including the step of directing at least a component of the air after it has heated the organic material in said organic material heating step into the combustion reactor wherein it is used as a part of the waste-burning air.

12. The method of claim 4 wherein said steps of heating said fluid medium with the heat recovered from said first combustion exhaust gas and with the heat recovered from a second combustion exhaust gas which is discharged from the combustion reactor are carried out in the same heat recovery device.

13. The method of claim 4 wherein said steps of heating said fluid medium with the heat recovered from said first combustion exhaust gas and with the heat recovered from a second combustion exhaust gas which is discharged from the combustion reactor are carried out in different respective heat recovery devices.

* * * * *